US007362292B2

(12) United States Patent
Deane et al.

(10) Patent No.: US 7,362,292 B2
(45) Date of Patent: Apr. 22, 2008

(54) ACTIVE MATRIX DISPLAY DEVICE

(75) Inventors: Steven C. Deane, Redhill (GB); Alan G. Knapp, Crawley (GB)

(73) Assignee: Koninklijke Philips Electronics, N.V., Eindhoven (NL)

( * ) Notice: Subject to any disclaimer, the term of this patent is extended or adjusted under 35 U.S.C. 154(b) by 180 days.

(21) Appl. No.: 10/562,104

(22) PCT Filed: May 28, 2004

(86) PCT No.: PCT/IB2004/001860

§ 371 (c)(1),
(2), (4) Date: Dec. 22, 2005

(87) PCT Pub. No.: WO2004/109647

PCT Pub. Date: Dec. 16, 2004

(65) Prior Publication Data

US 2007/0139320 A1 Jun. 21, 2007

(30) Foreign Application Priority Data

Jun. 6, 2003 (GB) ..... 0313040.8

(51) Int. Cl.
*G09G 3/36* (2006.01)

(52) U.S. Cl. ..... 345/87; 345/92; 345/98; 327/319

(58) Field of Classification Search ..... 345/87, 345/98, 99, 100; 315/169.1–169.4; 327/112, 327/170, 319
See application file for complete search history.

(56) References Cited

U.S. PATENT DOCUMENTS 4,771,278 A * 9/1988 Pooley ..... 345/73
5,831,467 A * 11/1998 Leung et al. ..... 327/319
6,100,868 A * 8/2000 Jeong et al. ..... 345/98
6,359,607 B1 3/2002 Yanagi et al.
6,943,786 B1 * 9/2005 Birk et al. ..... 345/204
6,970,152 B1 * 11/2005 Bell et al. ..... 345/100

* cited by examiner

*Primary Examiner*—Richard Hjerpe
*Assistant Examiner*—Kimnhung Nguyen

(57) ABSTRACT

An active matrix display device has column address circuitry for generating pixel drive signals. The column address circuitry has an output buffer for providing a pixel drive signal to a column conductor, and the positive and negative slew rates of the output buffer are different. By selecting the positive and negative slew rates independently in the design of the output buffer, the size of the transistors (54, 56), particularly those which pass the charging (or discharging) current of the column capacitance, can be kept to a minimum.

10 Claims, 6 Drawing Sheets

ACTIVE MATRIX DISPLAY DEVICE

This invention relates to active matrix display devices, and relates in particular to the circuitry used for providing drive signals to the pixels of the display.

Active matrix display devices, such as AMLCDs, typically comprise an array of pixels arranged in rows and columns. Each row of pixels shares a row conductor which connects to the gates of the thin film transistors of the pixels in the row. Each column of pixels shares a column conductor, to which pixel drive signals are provided. The signal on the row conductor determines whether the transistor is turned on or off, and when the transistor is turned on, by a high (or low) voltage pulse on the row conductor, a signal from the column conductor is allowed to pass on to a display element, e.g. an area of liquid crystal material, thereby altering the light output characteristics of the material. An additional storage capacitor may be provided as part of the pixel configuration to enable a voltage to be maintained on the display element even after removal of the row electrode pulse.

The frame (field) period for active matrix display devices such as AMLCDs requires a row of pixels to be addressed in a short period of time, and this in turn imposes a requirement on the current driving capabilities of the transistor in order to charge or discharge the liquid crystal material to the desired voltage level. In order to meet these current requirements, the gate voltage supplied to the thin film transistor needs to fluctuate between values separated by approximately 30 volts (for an amorphous silicon transistor). For example, the transistor may be turned off by applying a gate voltage of around −10 volts, or even lower, (with respect to the source) whereas a voltage of around 20 volts, or even higher, may be required to bias the transistor sufficiently to provide the required source-drain current to charge or discharge the liquid crystal material sufficiently rapidly.

The drive voltage for the LC material has a range of approximately 3V between black and transmissive states. Furthermore, the polarity of the voltage applied to the LC layer is alternated, and this reduces ageing of the LC characteristics. This inversion may be frame-by-frame or row-by-row or arranged differently. Typically, the column voltage for one polarity may be in the range 2V to 5V, and the column voltage for the opposite polarity may be in the range −2V to −5V. The column voltage thus has a full range of about 10V.

The driver ICs, especially the column drivers, constitute a considerable part of the cost of active matrix LCDs. Most column driver ICs contain a significant number of analogue components—e.g. resistor chains and often buffer amplifiers. These analogue circuit blocks tend to be large due to their complexity and need to use transistors with specific properties which may increase their size above the minimum. The area required by the column driver ICs contributes significantly to the cost of the display panel, and the output stage of the buffer amplifier in particular contributes to the required area of the driver IC. The output stage uses transistors for sourcing the currents required to charge the column capacitance to the desired pixel voltage in the available time, and these transistors draw the highest currents within the column driver IC and therefore need to be the largest devices.

The output stage is typically designed to provide a certain slew rate of the column voltage, so that the column capacitance can be charged sufficiently rapidly, as discussed above.

The output stage typically has a slew rate for an increasing column voltage which is equal to the slew rate for a decreasing column voltage.

According to a first aspect of the invention, there is provided an active matrix display device comprising an array of pixels arranged in rows and columns, wherein each column of pixels shares a column conductor to which pixel drive signals are provided, wherein column address circuitry is provided for generating the pixel drive signals, the column address circuitry comprising an output buffer for providing a pixel drive signal to a column conductor, wherein the positive and negative slew rates of the output buffer are different.

The invention is based on the recognition that the slew rate requirements for increasing and for decreasing output voltages are not the same. Thus, the buffer rise and fall times are different for a fixed load. By selecting the positive and negative slew rates independently in the design of the output buffer, the size of the transistors, particularly those which pass the charging (or discharging) current of the column capacitance, can be kept to a minimum.

For example, the output buffer may comprise a first transistor connected between the column conductor and a high power line and a second transistor connected between the column conductor and a low power line, wherein the slew rates of the first and second transistors are different. One of the transistors acts as a pull-up transistor (and thus determines the buffer positive slew rate) and the other acts as a pull-down transistor (and thus determines is the buffer negative slew rate).

The first transistor may comprise a p-type transistor and the second transistor may comprises an n-type transistor, and they may be switched simultaneously.

The pixels are preferably driven in different frames with different polarity pixel drive signals, and the pixel charging time from a first drive signal, having a first polarity and corresponding to a given brightness, to a second drive signal, having the opposite polarity and corresponding to the same given brightness, is substantially equal to the pixel charging time from the second drive signal to the first drive signal. In this way, the slew rates of the output buffer are selected so that the display pixel charging characteristics are the same for positive and negative fields in a polarity inversion scheme. This optimises the area saving available by providing unbalanced buffer rise and fall times.

Each pixel may comprise an n-type switching transistor, and the negative slew rate is then chosen to be lower than the positive slew rate. Thus, for the two transistor output stage described above, the first transistor has a lower maximum current drive than the first transistor, resulting in a lower negative slew rate than the positive slew rate.

Each pixel may instead comprise a p-type switching transistor, and the positive slew rate is then lower than the negative slew rate. Thus, the first transistor has a lower maximum current drive than the second transistor.

The invention also provides column address circuitry for driving the columns of an active matrix display, comprising an output buffer for providing a pixel drive signal to a column conductor, wherein the positive and negative slew rates of the output buffer are different.

Examples of the invention will now be described in detail with reference to the accompanying drawings, in which.

The same reference numbers and symbols are used throughout the Figure to denote the same or similar parts.

Figure 1:
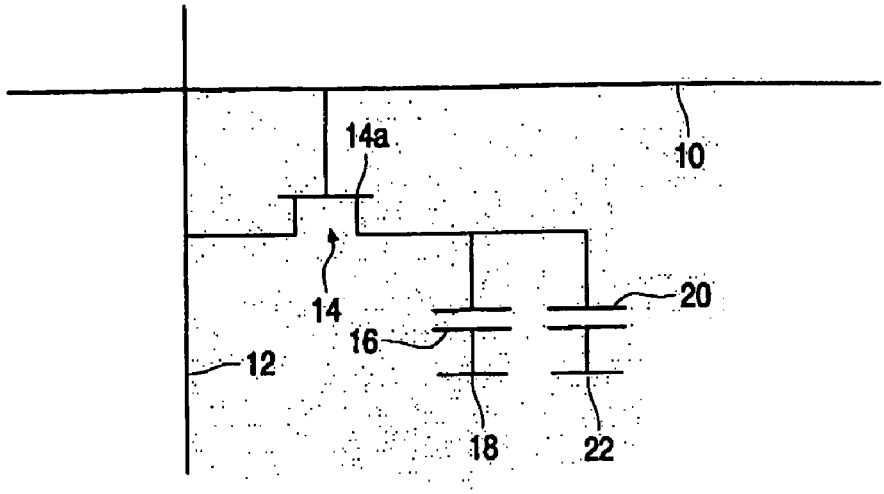
FIG. 1 shows one example of a known pixel configuration for an active matrix liquid crystal display.

FIG. 1 shows a conventional pixel configuration for an active matrix liquid crystal display. The display is arranged as an array of pixels in rows and columns. Each row of pixels shares a common row conductor 10, and each column of pixels shares a common column conductor 12. Each pixel comprises a thin film transistor 14 and a liquid crystal cell 16 arranged in series between the column conductor 12 and a common potential 18. The transistor 14 is switched on and off by a signal provided on the row conductor 10. The row conductor 10 is thus connected to the gate 14*a* of each transistor 14 of the associated row of pixels. Each pixel may additionally comprise a storage capacitor 20 which is connected at one end 22 to the next row electrode, to the preceding row electrode, or to a separate capacitor electrode. This capacitor helps to maintain the drive voltage across the liquid crystal cell 16 after the transistor 14 has been turned off. A higher total pixel capacitance is also desirable to reduce various effects, such as kickback, and to reduce the grey-level dependence of the pixel capacitance.

In order to drive the liquid crystal cell 16 to a desired voltage to obtain a required gray level, an appropriate signal is provided on the column conductor 12 in synchronism with a row address pulse on the row conductor 10. This row address pulse turns on the thin film transistor 14, thereby allowing the column conductor 12 to charge the liquid crystal cell 16 to the desired voltage, and also to charge the storage capacitor 20 to the same voltage.

Figure 2:
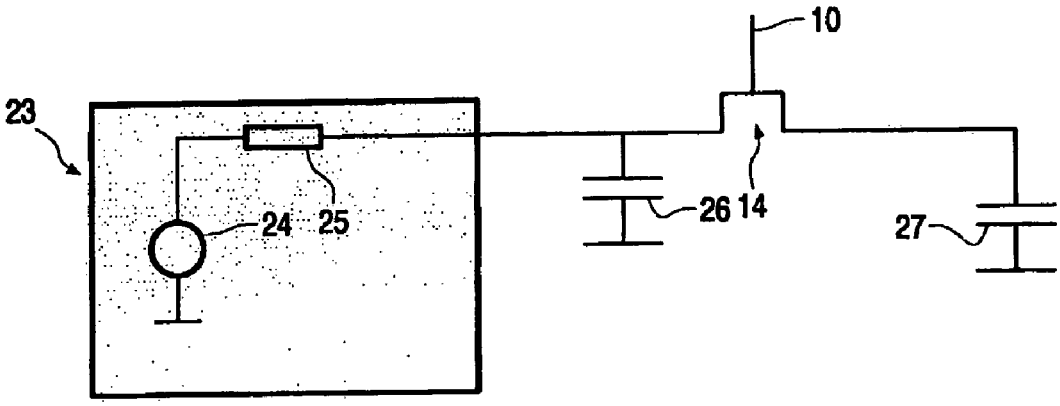
FIG. 2 is used to explain charge flow during pixel charging.

FIG. 2 shows the connection between the column driver 23 (which essentially comprises a voltage source 24 and a switch having resistance 25) and the pixel of the column in the selected row. The column has a column capacitance 26, which results, for example, from all of the cross overs of the column with the row conductors. The individual pixel has a pixel capacitance 27. The column drive signal results in charging of both capacitances 26 and 27. However the time constant for charging the column capacitor 26 (resistance 25×capacitance 26) is much lower than the time constant for charging the pixel (TFT resistance×capacitance 27). Thus, a short column address pulse is required to charge the column capacitance 26.

At the end of the row address pulse, the transistor 14 is turned off. The storage capacitor 20 reduces the effect of liquid crystal leakage and reduces the percentage variation in the pixel capacitance caused by the voltage dependency of the liquid crystal cell capacitance. The rows are typically addressed sequentially so that all rows are addressed in one frame period, and refreshed in subsequent field periods.

Figure 3:
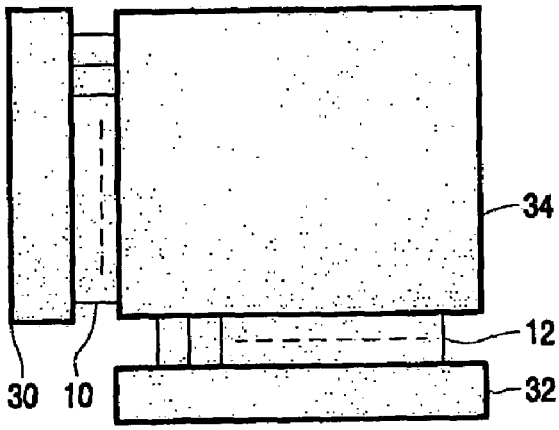
FIG. 3 shows a display device including row and column driver circuitry.

As shown in FIG. 3, the row address signals are provided by row driver circuitry 30, and the pixel drive signals are provided by column address circuitry 32, to the array 34 of display pixels.

Figure 4:
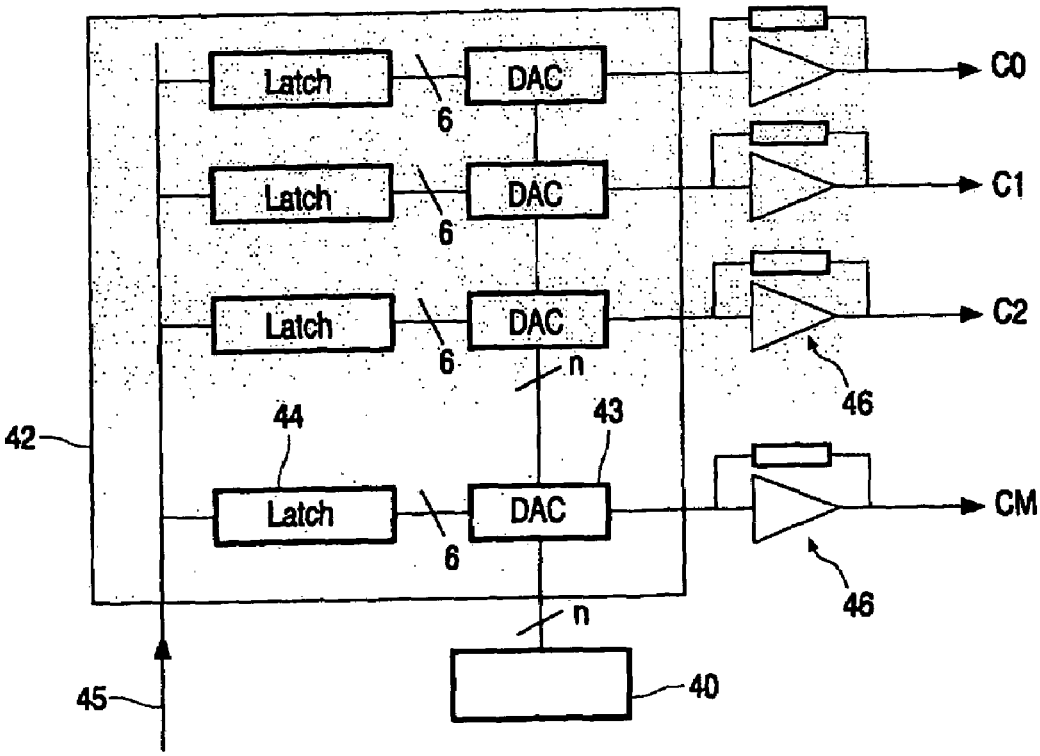
FIG. 4 shows a conventional column driver circuit.

FIG. 4 shows a conventional column driver circuit. The number n of different pixel drive signal levels are generated by a grey level generator 40, for example a resistor array. A switching matrix 42 controls the switching of the required level to each column and comprises an array of converters 43 for selecting one of the n grey levels based on a digital input from a latch 44. The digital input is derived from a RAM storing the required image data 45. Each column is provided with a buffer 46 for holding a pixel in the column to the required drive signal level for the full duration of the row address period. The buffers in particular contribute to the substrate area required by the column is driver IC and hence the cost.

Figure 5:
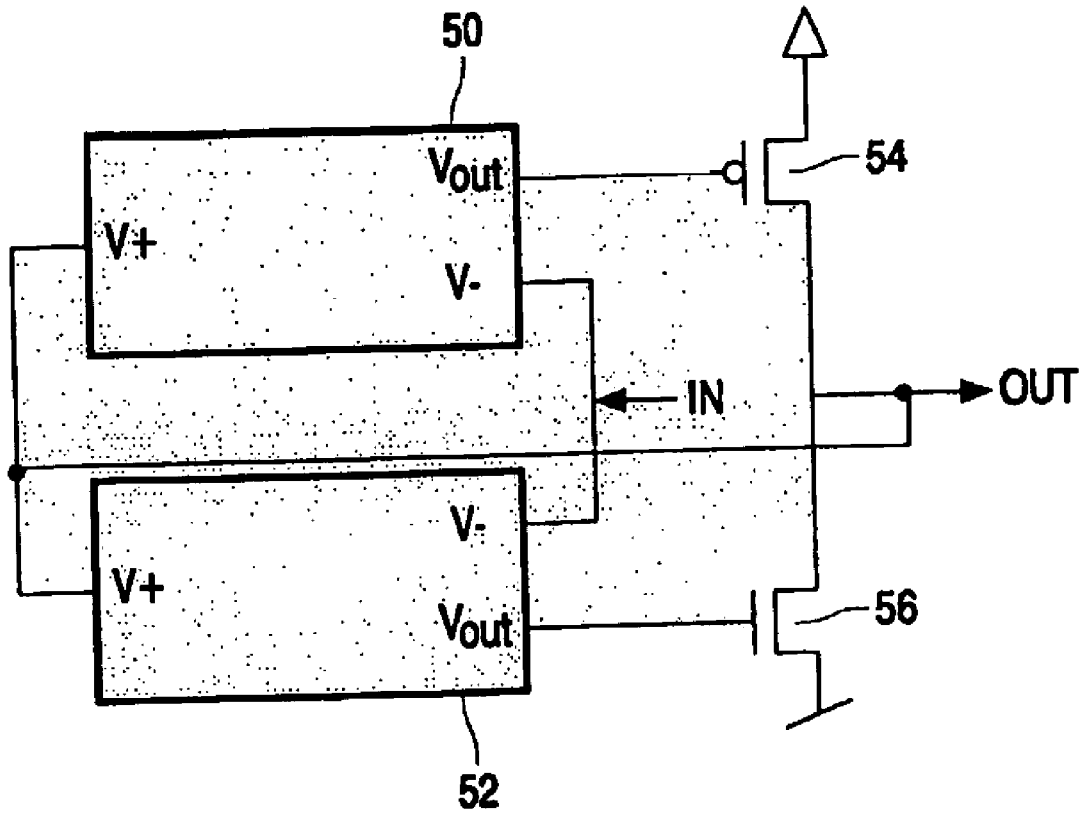
FIG. 5 shows a known output buffer of the column driver circuit of FIG. 4.

FIG. 5 shows schematically one possible known design for the output buffer. The buffer receives as input the desired analogue pixel drive level at input "IN". The circuit comprises two differential amplifiers 50, 52. The non-inverting terminal of each differential amplifier is connected to the output "OUT" so that feedback control of the output voltage is implemented. The inverting terminal of each differential amplifier is connected to the input "IN".

The circuit has an output stage comprising a p-type pull-up transistor 54 and an n-type pull down transistor 56. These are connected in series between power supply lines, for example the positive and negative voltage rails The high power supply line provides the maximum required pixel drive voltage (e.g. 5V) and the low power supply line provides the minimum pixel drive voltage (e.g. −5V).

When the input voltage at "IN" is higher than the output voltage at "OUT", differential amplifier 50 turns on the pull up transistor 54 so that a current flows through the transistor 54 to charge the output column capacitance. Similarly, when the input voltage is lower than the output voltage, differential amplifier 52 turns on the pull down transistor 56, so that current flows through transistor 56 to discharge the output load.

The feedback arrangement thus ensures that the output voltage is equal to the input voltage. The design of the differential amplifiers 50, 52 is not relevant to this invention and will not be discussed in detail. Furthermore, other functions may be implemented in the output buffer circuit, which will not be discussed.

The transistors 54,56 need to supply sufficient currents to the column to charge or discharge the column capacitance sufficiently rapidly, and the output stage therefore contributes most significantly to the circuitry area.

The n-type transistor has a higher mobility, and can therefore be designed with smaller area to achieve the same slew rate. For example, the channel width of transistor 56 may typically be around half the channel width of the transistor 54.

The transistor 54 is essentially used for pulling up the column voltage when there is a transition in the pixel drive voltage from a negative polarity field to a positive polarity field, and transistor 56 is essentially used for pulling down column voltage when there is a transition in the pixel drive voltage from a positive polarity field to a negative polarity field. The voltage swings as a result of polarity inversion are greater than those as a result of the change in desired pixel brightness, and there is typically a polarity inversion at each sequential addressing of each pixel.

The invention is based on the recognition that the slew rate requirements for the transistors 54 and 56 are not the same.

Figure 6:
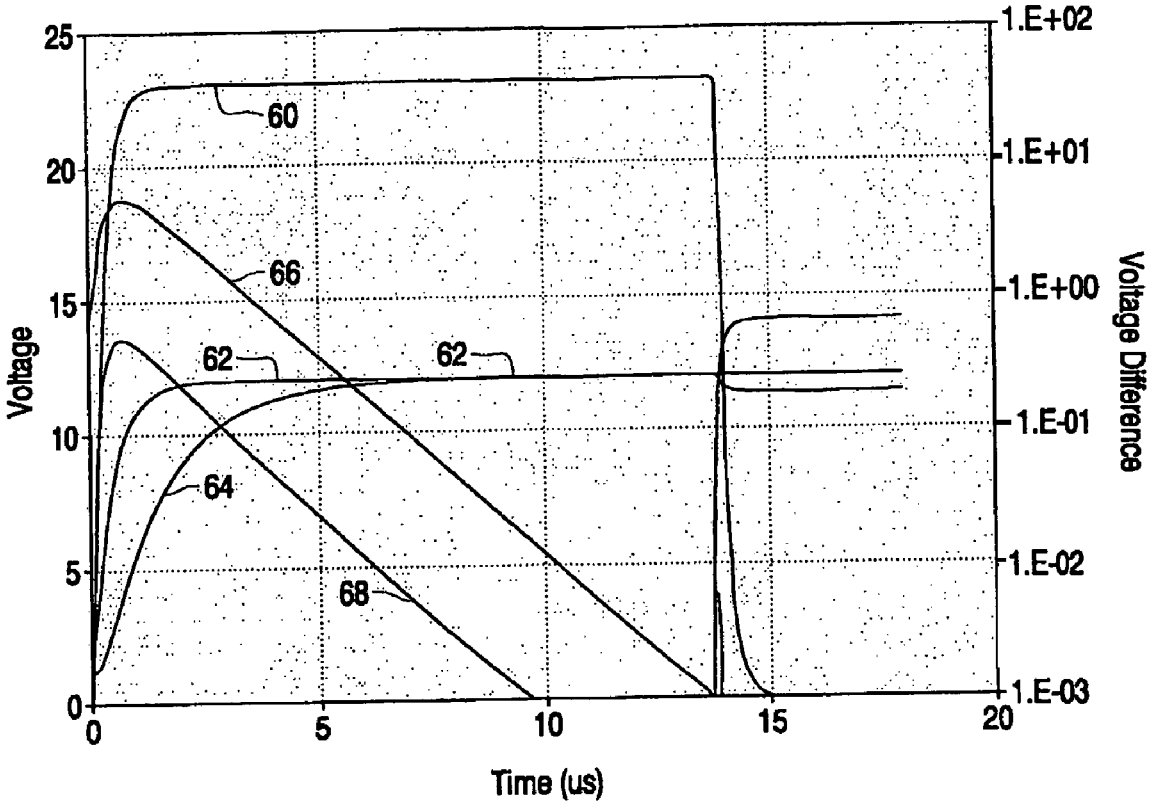
FIG. 6 shows the pixel charging characteristics in the positive field for a conventional column driver.

FIG. 6 shows the pixel charging characteristics in the positive field for a conventional column driver. Plot 60 shows the row voltage pulse, which is applied to the gate of the pixel transistor 14 (FIG. 1). The column voltage 62 rises to its target of 12V (in this simulation) in an exponential manner. The starting voltage is 2V, which as will be seen below corresponds to the negative field target. The pixel voltage 64 rises slightly less rapidly because of the high transistor resistance giving rise to larger (i.e. slower) pixel time constant. Plot 66 shows the voltage across the pixel TFT, namely the difference between the instantaneous pixel voltage and the column voltage. Assuming the pixel is charged when the difference drops to 0.01V (1.E-02), the pixel charging takes 10.3 μs in this simulation, which is when plot 66 crosses the 0.01 value. Plot 68 shows the voltage on one end of the storage capacitor, referenced 22 in FIG. 1.

Figure 7:
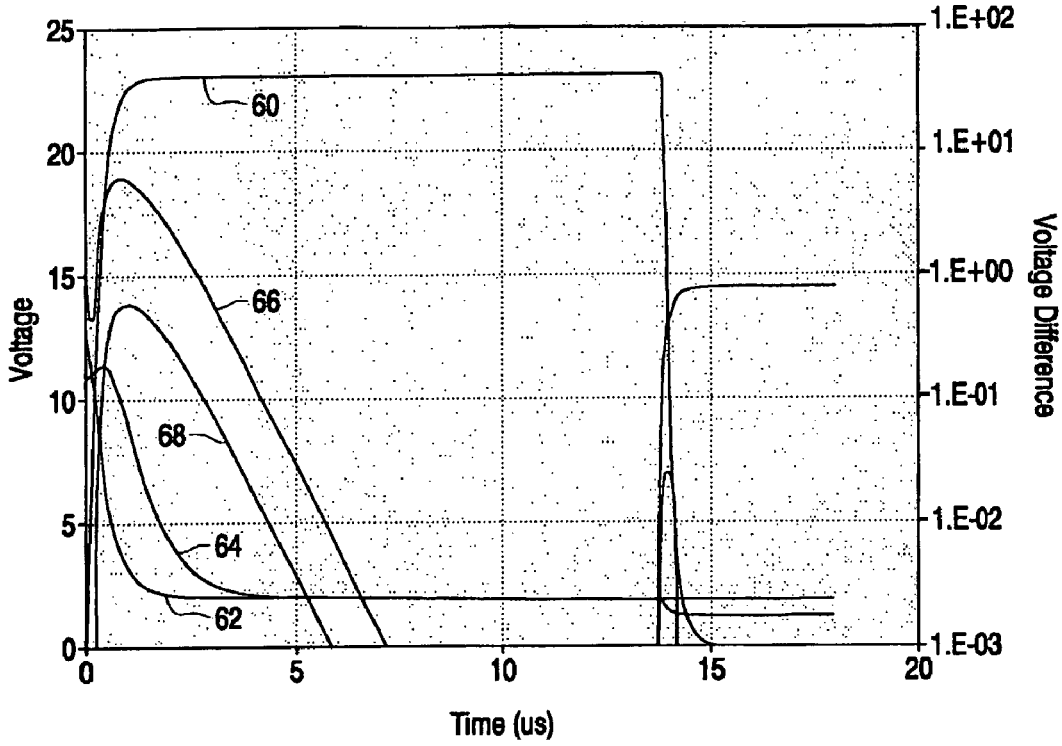
FIG. 7 shows the pixel charging characteristics in the negative field for a conventional column driver.
Figure 8:
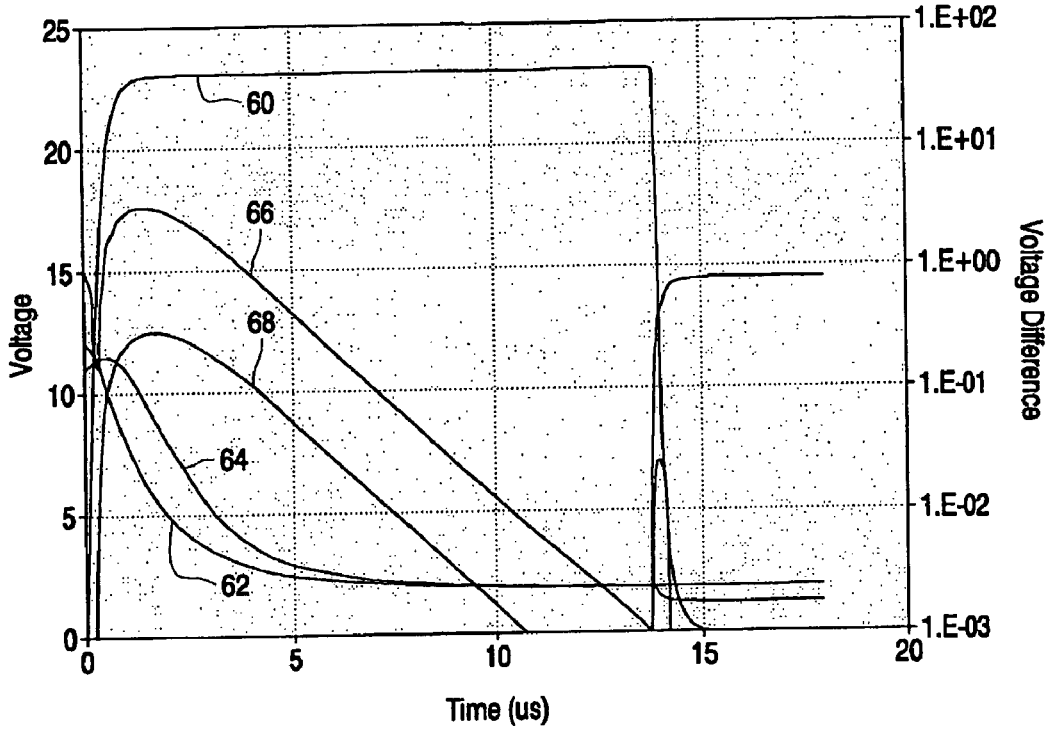
FIG. 8 shows the pixel charging characteristics in the negative field for one example of column driver of the invention.

In FIGS. 6-8, plots 60, 62 and 64 use the linear scale on the left, and plots 66 and 68 use the logarithmic scale on the right.

FIG. 7 shows the same plots as FIG. 6 for pixel charging characteristics in the negative field for a conventional column driver. The starting pixel voltage is 12V, from the previous positive field. In this case, the column voltage target is 2V (i.e. 10V below the positive field voltage). The pixel voltage reaches this target, again to within 0.01V, in 5.6 μs.

The pixel charging is thus much more rapid in the negative field when a column driver is used having equal positive and negative slew rates. This is the result of the identical row pulse used for the positive and negative fields, which give rise to different pixel transistor turn-on characteristics in the two polarity fields. The effective gate voltage is much higher in the negative field.

The actual voltages are not significant, and the selected voltages of 2V and 12V are merely by way of example for simulation purposes.

In accordance with the invention, the column driver buffer is designed to have different positive and negative slew rates.

FIG. 8 shows the same plots as FIG. 7, again for pixel charging characteristics in the negative field, but for a column driver modified in accordance with the invention.

Assuming a column driver architecture as shown in FIG. 5, the invention allows the size of the transistor 56 to be reduced so that the column driver no longer has balanced positive and negative slew rates. Instead, the negative (pull-down) slew rate is lower, but the rise and fall characteristics of the output buffer become balanced as a result of the different load (i.e. pixel) characteristics. In FIG. 8, the reduction in the size of the transistor 56 results in an increase in the pixel charging time from 5.6 μs (as in FIG. 7) to 10.3 μs so that the pixel charging rate for pixels in the positive and negative fields are substantially the same. This allows the greatest saving in chip area without compromising the overall output characteristics of the column driver circuit.

The voltage levels given in the simulations above are based on the assumption that the pixel comprises an amorphous silicon n-type TFT. The invention can also be applied to display devices in which the pixel TFT is a p-type transistor, for example a low temperature polysilicon (LTPS) transistor. In such a case, the pull-up time is more rapid (i.e. the positive polarity field), so that the invention in that case enables a reduction in the size of the pull-up transistor 54.

Specific examples of the dimensions for the two transistors in the output stage of the column driver buffer have not been given. The transistors will be designed in each case taking into account the electrical characteristics and drive scheme of the pixel array. These will of course be very different for different size of displays, for displays using different technologies, and for displays with different timing requirements (for example refresh rates). For a given display, it will be a routine matter for those skilled in the art to design the output stage of the buffer, using the teachings above, to provide substantially equal rise and fall times of the pixel voltage for the particular display. In this way, any excessive margin is removed and the column driver design is optimised.

The column driver circuit may have an output buffer for each column of the display. Multiplexing schemes are also known which allow a reduction in the circuitry component count, and provide addressing of the columns in groups rather than all simultaneously. Known multiplexing schemes can be applied to the architecture of the invention in routine manner, and these multiplexing architectures will not be discussed in this application.

The invention has been described as allowing a reduction in size of one of the main current providing transistors in the output stage of the buffer, as these are the largest, high-current devices in the column driver IC. However, the invention may also allow consequential size reductions in the circuit elements providing drive signals to the output stage transistors.

The invention has been described in detail in connection with an LCD display. However, the invention may also be applied to other voltage-addressed displays.

In this description and claims, the term "positive slew rate" is used to denote the maximum rate of change of output voltage for a step input voltage change which results in the output voltage increasing, and the term "negative slew rate" is used to denote the maximum rate of change of output voltage for a step input voltage change which results in the output voltage decreasing.

Other features of the invention will be apparent to those skilled in the art.

The invention claimed is:

1. An active matrix display device comprising an array of pixels arranged in rows and columns, wherein each column of pixels shares a column conductor to which pixel drive signals are provided, wherein column address circuitry is provided for generating the pixel drive signals, the column address circuitry comprising an output buffer for providing a pixel drive signal to a column conductor, wherein the positive and negative slew rates of the output buffer are different and wherein the output buffer comprises a first transistor connected between the column conductor and a high power line and a second transistor connected between the column conductor and a low power line, wherein the slew rates of the first and second transistors are different.

2. A device as claimed in claim 1, wherein each pixel comprises an n-type switching transistor, and wherein the negative slew rate is lower than the positive slew rate.

3. A device as claimed in claim 2, wherein the second transistor has a lower maximum current drive than the first transistor.

4. A device as claimed in claim 1, wherein each pixel comprises a p-type switching transistor, and wherein the positive slew rate is lower than the negative slew rate.

5. A device as claimed in claim 4, wherein the first transistor has a lower maximum current drive than the second transistor.

6. A device as claimed in claim 1, comprising an output buffer (46) for each column.

7. A device as claimed in claim 1, comprising an active matrix LCD display device.

8. A device as claimed in claim 1, wherein the first transistor comprises a p-type transistor and the second transistor comprises an n-type transistor, and wherein the first and second transistors are switched simultaneously.

9. Column address circuitry for driving the columns of an active matrix display, comprising an output buffer for providing a pixel drive signal to a column conductor, wherein the positive and negative slew rates of the output buffer are different and wherein the output buffer comprises a first transistor connected between the column conductor and a high power line and a second transistor connected between the column conductor and a low power line, wherein the slew rates of the first and second transistors are different.

10. An active matrix display device comprising an array of pixels arranged in rows and columns, wherein each column of pixels shares a column conductor to which pixel drive signals are provided, wherein column address circuitry is provided for generating the pixel drive signals, the column address circuitry comprising an output buffer for providing a pixel drive signal to a column conductor, wherein the positive and negative slew rates of the output buffer are different wherein the pixels are driven in different frames with different polarity pixel drive signals, and wherein the pixel charging time from a first drive signal, having a first polarity and corresponding to a given brightness, to a second drive signal, having the opposite polarity and corresponding to the same given brightness, is substantially equal to the pixel charging time from the second drive signal to the first drive signal.

* * * * *